US005245937A

United States Patent [19]

Nakase et al.

[11] Patent Number: 5,245,937

[45] Date of Patent: Sep. 21, 1993

[54] METHOD AND APPARATUS FOR BURNING COMBUSTIBLE SOLID RESIDUE FROM CHEMICAL PLANT

[75] Inventors: Noriaki Nakase; Masao Koyama; Masahiro Inada, all of Tokyo; Toshiaki Masaoka, Yamaguchi; Tohoru Abiko, Yamaguchi; Kenji Takahashi, Yamaguchi, all of Japan

[73] Assignees: Mitsui Engineering & Shipbuilding Co., Ltd.; Mitsui Petrochemical Industries, Ltd., both of Tokyo, Japan

[21] Appl. No.: 529,435

[22] Filed: May 29, 1990

[30] Foreign Application Priority Data

May 29, 1989 [JP] Japan ..... 1-132809

[51] Int. Cl.[5] ..... F23G 5/00

[52] U.S. Cl. ..... 110/346; 110/234; 110/238; 588/205

[58] Field of Search ..... 110/238, 346, 234; 588/205

[56] References Cited

U.S. PATENT DOCUMENTS 3,954,381 5/1976 marecaux ..... 110/238 X
4,405,564 9/1983 Herbort et al. .
4,509,434 4/1985 Boday et al. ..... 110/238
4,867,674 9/1989 Keller et al. .

FOREIGN PATENT DOCUMENTS 2733841 2/1979 Fed. Rep. of Germany ..... 110/238
761617 11/1956 United Kingdom .
950345 2/1964 United Kingdom .

OTHER PUBLICATIONS

Japanese Patents Gazette, Derwent Publications Ltd., JP-A-52 51770 (Mitsui Petrochem KK) Apr. 25, 1977.

*Primary Examiner*—Edward G. Favors
*Attorney, Agent, or Firm*—Sherman and Shalloway

[57] ABSTRACT

A method of burning a combustible solid residue from a chemical plant, which comprises feeding a slurry of combustible solid residues in an oil, the amount of the oil being at least 0.5 part by weight per part by weight of the combustible solid residues, into a burner in a combustion furnace comprised of a main combustion chamber having the burner in its arch, a secondary combustion chamber formed in the lower portion of the main combustion chamber, and a flue gas duct provided beneath and following the secondary combustion chamber, burning the residue in the main combustion chamber, conducting the combustion gas into the secondary combustion chamber, and allowing it to reside at a temperature 800° to 1000° C. for at least 0.5 second.

17 Claims, 3 Drawing Sheets

METHOD AND APPARATUS FOR BURNING COMBUSTIBLE SOLID RESIDUE FROM CHEMICAL PLANT

This invention relates to a method and an apparatus for burning a combustible solid residue discharged from a chemical plant, particularly a terephthalic acid manufacturing plant. More specifically, this invention relates to a method and an apparatus for burning a combustible solid residue discharged from a chemical plant, particularly a terephthalic acid manufacturing plant, and simultaneously heating a heating medium which is used to heat or warm the process fluid through machines or devices of the plant by utilizing the heat of burning.

The residue discharged from the terephthalic acid production plant contains terephthalic acid, isophthalic acid, benzoic acid, p-toluic acid, by-product high-boiling compounds and and the waste catalyst. These residues are solid at room temperature, and combustible (these residues will be referred to as combustible solid residues). In a commercial plant, these residues have heretofore been burned in an independent incinerator. Specifically, an incinerator shown, for example, in FIG. 3, is used, and a heavy oil or a gas fuel is fed into an auxiliary burner 21 to heat a furnace 22 to a high temperature. Meanwhile, combustible solid residues are fed from a residue feed inlet 24 onto a hearth 23 and burned (the hearth burning method). As another method, an aqueous slurry of the combustible solid residue is fed into a spray nozzle 25 via a slurry pipe 30, as shown in FIG. 4. The inside of the furnace 22 is heated to a high temperature by the auxiliary burner 21. The combustible solid residues are dispersed in the furnace 22 by the spray and burned. (In FIGS. 3 and 4, G represents a combustion waste gas.)

In the prior methods described above, heavy oil or a gas fuel such as LPG is required as an auxiliary fuel for the complete burning treatment of the combustible solid residues. This is an extra input of energy in the plant, and is uneconomical.

On the other hand, in the terephthalic acid manufacturing plant, a furnace 26 adapted to be heated by a heating medium is provided within the plant separately from the incinerator as shown in FIG. 5 to heat or warm machines or devices, and are continuously operated. Usually, heavy oil or a gas fuel such as LPG is used as a fuel to be fed to a burner 34 of the heating medium furnace 26 via a fuel pipe 33.

In FIG. 5, the heating medium comes from a heating medium inlet 31, and is heated. Thereafter, it goes out from a heating medium outlet 32 and is circulated for keeping the machines or devices warm. The combustion waste gas G is discharged from a stack 35.

In the incinerator shown in FIG. 3, the ash on the hearth 23 is difficult to remove, and troubles such as the damage of the hearth bricks or castable owing to the melting of the ash of the hearth bricks or castable occur. In the incinerator of FIG. 4, an extra thermal energy is required because of the latent heat of vaporization of water from the aqueous slurry in the combustible solid residues fed. Furthermore, bricks or castable 36 of the side wall of the furnace is rapidly cooled by a water spray, or heated by the auxiliary burner 21 to induce a temperature variation in the wall surface of the furnace. This tends to damage the wall surface.

If it is attempted to utilize the combustible solid residues effectively by feeding the residues in the form of an aqueous slurry or an oil slurry into a radiation section 27 which is a combustion chamber of the heating medium furnace 26 of a conventional type and burning them, unburned residues and the waste catalyst in the residues sediment on the hearth surface and at the same time, adhere as a dust to a heat recovery section provided in the upper part of the radiation section 27, i.e., a heating pipe 29 of a convection section 28. Accordingly, the adhering dust reduces the heat convecting property of the convection section 28 within a short period, and at times, the flue gas flow rate must be decreased because of increasing of pressure drop due to fouling on the convection tube 29. Hence, the heating medium furnace 26 should be periodically shutdown and cleaned. In particular, in this type of heating furnace, a secondary combustion chamber cannot be provided because of its structure, and furthermore, since a heating pipe 30 is provided in the side wall of the radiation section 27 which is a combustion chamber, the temperature of the inside of the furnace is lowered to that of this portion, and the residue tends to remain unburned.

On the other hand, when in the combustion furnace shown in FIG. 4, an oil such as heavy oil is used instead of water as a transporting medium and a spray medium for the residues, the quantity of heat adds to the quantity of heat resulting from burning of the combustible residues, and the temperature of the inside of the furnace becomes extraordinarily high. This causes damage to refractory material of the wall of the furnace, and renders the furnace inoperative.

It is a primary object of this invention to provide a method and an apparatus for burning a combustible solid residue from a chemical plant, which is free from the problems of the conventional burning method and apparatus described above.

Another specific object of this invention is to provide a method and a burning furnace for burning combustible solid residues discharged from a chemical plant, particularly a terephthalic acid manufacturing plant, and at the same time, utilizing the heat resulting from burning to heat a heating medium which is used to heat or warm the process fluid through machines or devices of the plant.

Other objects of the invention along with its characteristic features will become apparent from the following detailed description.

According to one aspect, there is provided a method of burning combustible solid residues from a chemical plant, which comprises feeding a slurry of the combustible solid residue in an oil, the amount of the oil being at least 0.5 part by weight per part by weight of the combustible solid residue, into a burner of a combustion furnace comprised of a main combustion chamber having the burner in its arch, a secondary combustion chamber provided in the lower portion of the main combustion chamber, and a flue gas duct provided beneath and following the secondary combustion chamber, burning the residue in the main combustion chamber, conducting the combustion gas into the secondary combustion chamber, and allowing it to reside at a temperature 800° to 1000° C. for at least 0.5 second.

According to another aspect of this invention, there is provided a combustion furnace for burning combustible solid residues from a chemical plant, comprising a main combustion chamber having a burner in its arch and a heating pipe disposed perpendicularly along a side wall surface, a secondary combustion chamber provided in the lower part of the main combustion chamber, a flue gas duct provided beneath the secondary combustion chamber, and a burning residue reservoir chamber provided at the bottom of the secondary combustion chamber.

In the accompanying drawings:

FIG. 1 is a side elevation of one embodiment of a combustion furnace for burning combustible solid residues which are produced as by-products in a reaction step of a terephthalic acid manufacturing plant. FIG. 2 is a side elevation which conceptually illustrates the flow of a combustion gas.

Figure 1:
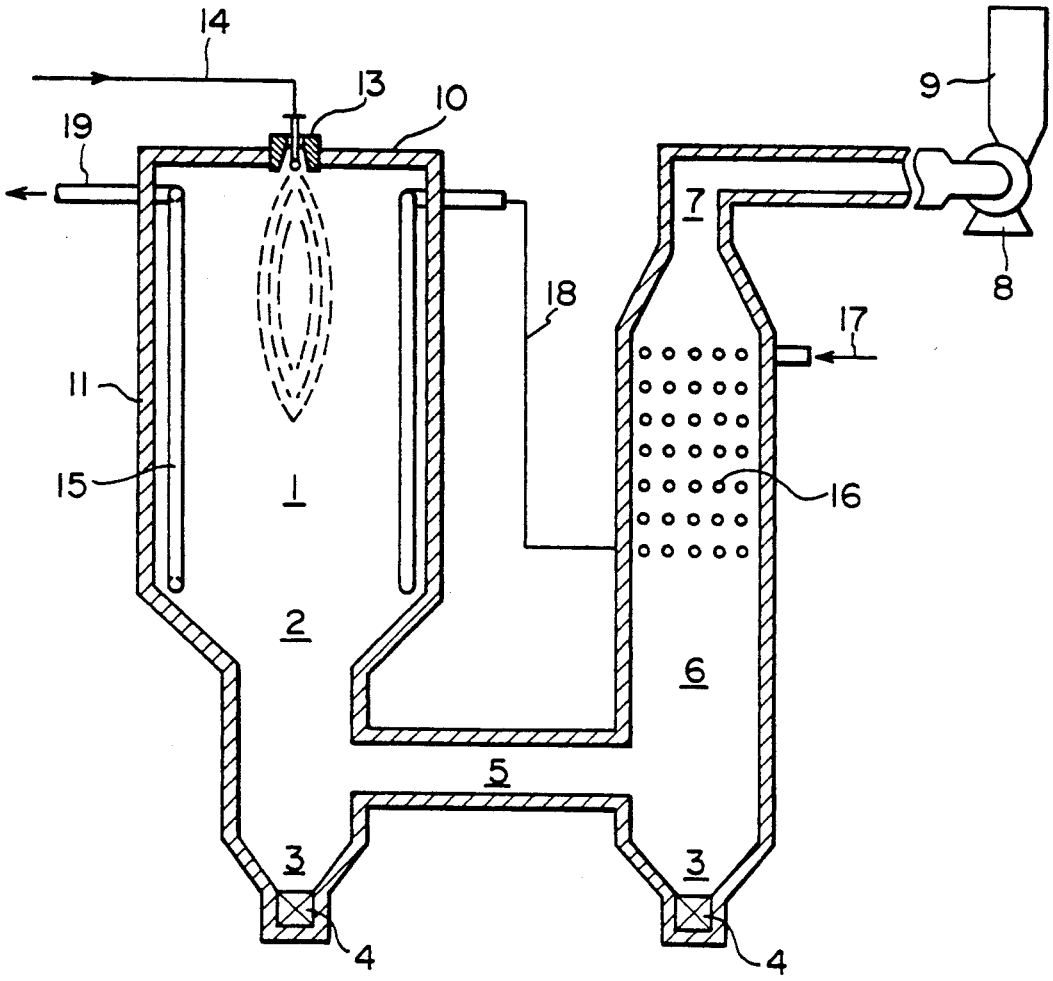
FIG. 1 is a side elevation showing the structure of a heating medium furnace in one embodiment of the invention in which combustible sold residues are used as a fuel.

In the embodiment shown in FIG. 1, the combustion furnace is comprised of a main combustion chamber 1 having a burner 13 at its arch 10, a secondary combustion chamber 2 provided in the lower part of the main combustion chamber 1, and a flue gas duct provided beneath and following the secondary combustion chamber 2. A burning residue reservoir chamber 3 is provided at the bottom of the secondary combustion chamber for reserving solid burning residues such as the waste catalyst and ash. These residues are periodically discharged from a discharge port 4 out of the furnace.

In a side wall 11 of the main combustion chamber 1, a heating pipe 15 is disposed vertically along its side wall 11 as required and preferably to protect the side wall 11 and to adjust the temperature of the inside of the combustion chamber 1 and the temperature of a combustion gas to be conducted to the secondary combustion chamber 2. Since the heating pipe 15 is provided vertically, ash and other adhering matter are permitted to fall down spontaneously. Hence, the heating pipe 15 can be designed and arranged such that it is convenient for this purpose.

Conveniently, the secondary combustion chamber 2 is formed in a conical or pyramidal shape as shown to facilitate the dropping of the residue such as ash into the reservoir chamber 3. Examples of the oil that can be used to slurry the combustible solid residues are light oil, heavy oil and cracked oils formed as by-products in an olefin plant. C heavy oil is especially preferred. To burn the residue completely and prevent plugging of the burner 13, the combustible solid residues to be dispersed in the oil is desirably pulverized in a size of generally 10 mesh pass, preferably 40 to 60 mesh pass. The proportion of the oil to be mixed with regard to the proportion of the pulverized combustible solid residue is at least 0.5 part by weight, preferably at least 1.0 part by weight, per part by weight of the pulverized combustible solid residue.

The oil slurry of the combustible solid residue is fed into the burner 13 opening into the main combustion chamber 1 from a pipe 14, and burned there. A heating medium in the heating pipe 15 is heated by the radiation heat resulting from this burning. On the other hand, by controlling the temperature and/or the flow rate of the heat medium flowing in the heating pipe 15 and the feed rate of the oil slurry fed to the burner, the temperature in the main combustion chamber 1 shown by A in FIG. 2 is adjusted such that the temperature of the combustion gas in the secondary combustion chamber, shown by B, is about 800° to about 1000° C., preferably about 850° to about 950° C.

Figure 2:
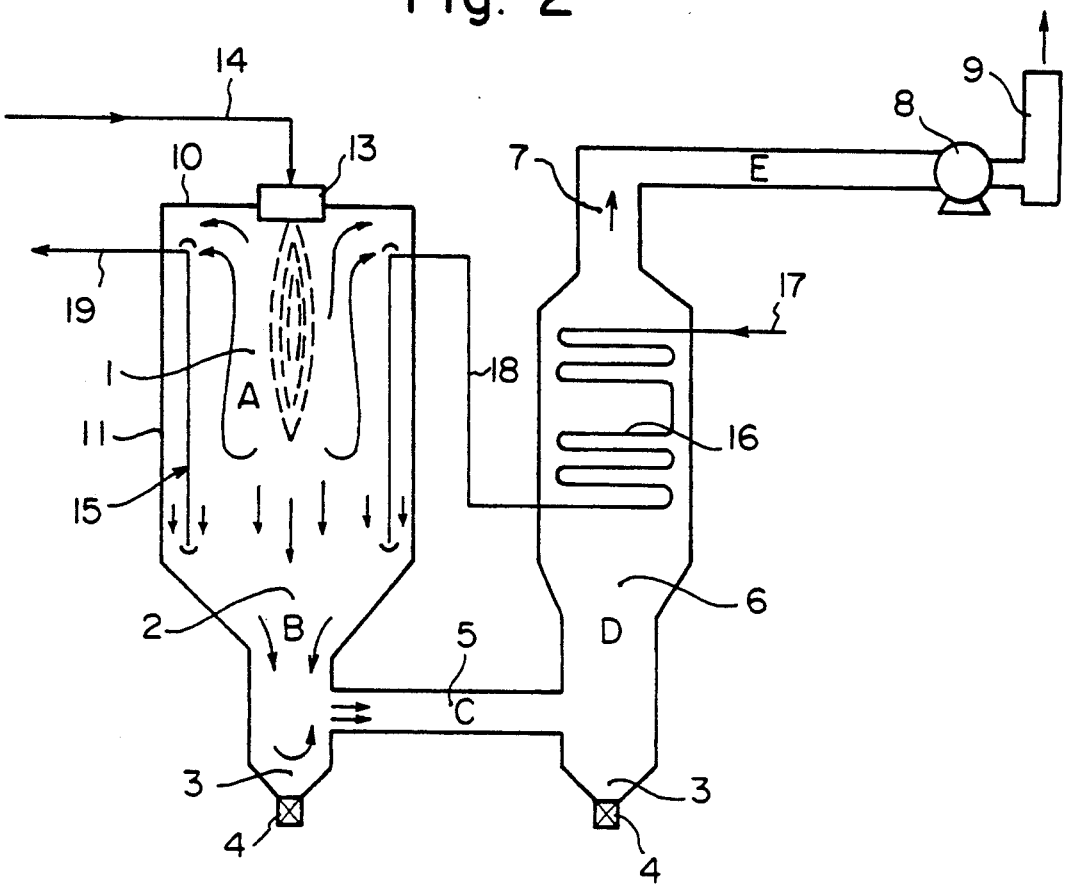
FIG. 2 is a side elevation for illustrating the heating flow of FIG. 1.
Figure 3:
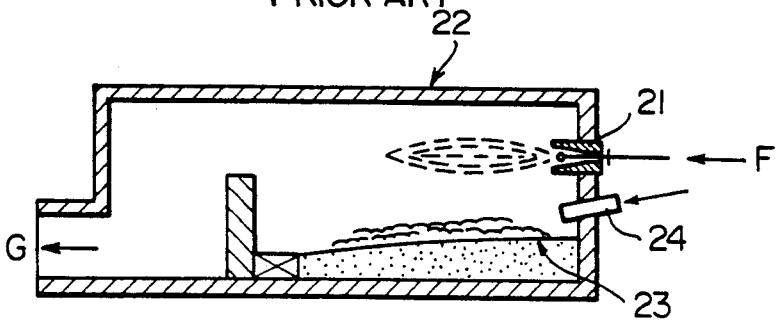
Fig. 3 PRIOR ART
FIGS. 3 and 4 are side elevations of different conventional incinerators for burning combustible solid residues.
Figure 4:
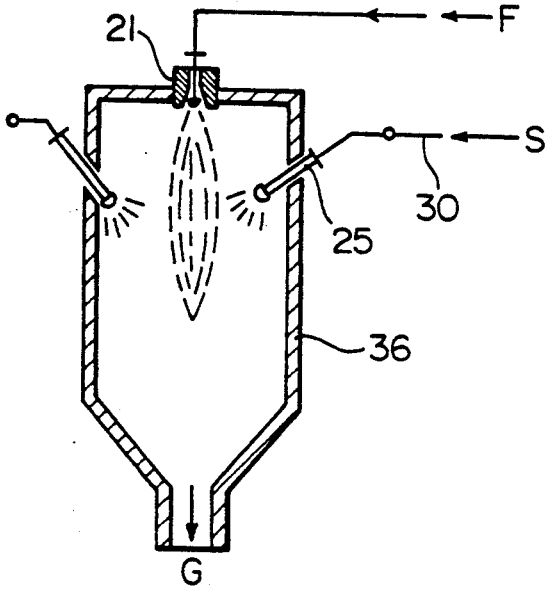
Fig. 4 PRIOR ART
Figure 5:
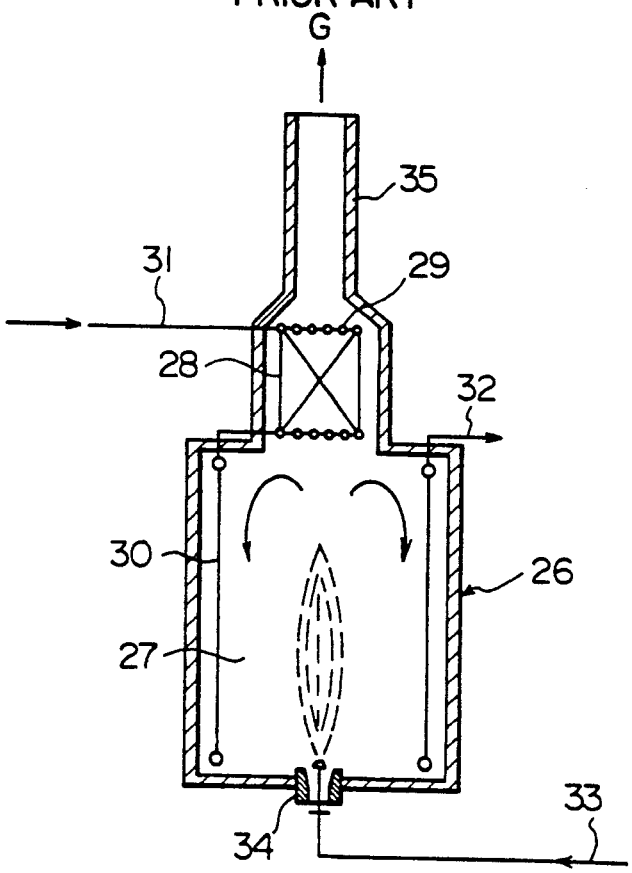
Fig. 5 PRIOR ART
FIG. 5 is a side elevation of a conventional heating medium furnace.

The introduction of the combustion gas resulting from the burning of the oil slurry in the main combustion chamber 1 to the secondary combustion chamber 2, i.e., the flow of the combustion gas shown by an arrow in FIG. 2 can be easily carried out, for example, by sucking it with an induced draft fan 8 provided at the tip of the second flue gas duct 7, and the sucked flue gas can be discharged from the stack 9.

Desirably, the residence time of the combustion gas in the secondary combustion chamber 2 is adjusted to at least 0.5 second, preferably 0.5 to 1.0 second.

The combustion gas sucked via the flue duct 5 can be discharged via the induced draft fan and the stack. If desired and preferably, to completely burn residues which may possibly remain unburned in the combustion gas, a tertiary combustion chamber 6 may be interposed between the flue duct 5 and the induced draft fan 8 so that the combustion gas can be discharged from the second flue gas duct 7 from the tertiary combustion chamber 6.

The residence time of the combustion gas in the tertiary combustion chamber 6 represented by D in FIG. 2 is suitably at least 0.5 second, preferably 0.5 to 1.0 second.

Desirably, the tertiary combustion chamber 6 is provided vertically as shown and the second flue gas duct 7 is connected to the breaching of the tertiary combustion chamber 6 so that the dust or ash is easy to drop spontaneously by gravity. As a result, a horizontal duct is formed between the tertiary combustion chamber 6 represented by D and the second flue gas duct 7 represented by E. At the bottom of the tertiary combustion chamber 6, a dust or ash reservoir chamber 3 is provided so that the dust or ash may be taken out from the discharge port 4 periodically.

Furthermore, in the tertiary combustion chamber 6, the heating pipe 16 leading from a heating medium inlet pipe 17, a preheater for the heating medium, or a waste heat boiler may be provided to recover heat.

The heating pipe 16 in the tertiary combustion chamber 16 may be, as shown, connected to the heating pipe 15 to the main combustion chamber 1 via a crossover pipe 18. The heating medium which is heated by utilizing the heat of combustion of the oil slurry of the combustible solid residues can be withdrawn from the heating medium outlet tube 19 and can be utilized for maintaining the temperature of machines or devices of the plant, or heating boiler water or another heating medium.

The residence time of the combustion gas in the second flue gas duct 7 shown by E in FIG. 2 is not limited at all, and is dependent upon its length and diameter, or the temperature of the combustion gas.

In the preferred embodiment described above, the combustion gas is introduced from the flue gas duct 5 to the tertiary combustion chamber 6. In the tertiary combustion chamber 6, the combustion gas is completely burned and the scattering ash is caught. Then, the ash is discharged from the ash reservoir chamber 3 provided as in the secondary combustion chamber 2 and the ash discharge port 4.

The combustion gas is cooled by heat exchanged with the heating medium in the heating pipe 16 in the secondary combustion chamber, sucked by the induced draft fan 8 via the second flue gas duct 7, and discharged from the stack 9.

The amount of the dust in the discharge flue gas discharged from the stack 9 can be reduced to 100 mg to 150 mg/NM$^3$ (discharged gas) by using this one embodiment of the apparatus. For pollution control, there is no need for an additional dust removing apparatus such as an electric precipitator.

As described hereinabove, according to the burning method and the combustion furnace of this invention using combustible solid residues as a fuel, the quantity of the heat of combustion of the solid residues can be effectively utilized, and the amount of the fuel used in that plant can be saved. For example, in the terephthalic acid manufacturing plant, about 12% of heavy oil can be saved. Furthermore, a fuel is no longer needed for an independent incinerator.

According to this invention, refractory material of the wall surface of the furnace are not locally overheated as in the conventional incinerator. Further, the damage of the refractory wall due to rapid heating and cooling by a conventional spraying method using an aqueous slurry of combustible solid residues can be prevented by this invention by providing a heating pipe adapted to be heated by a heat medium.

Moreover, the speed of burning an oil slurry of the solid residue becomes faster than in the case of the conventional burning of the aqueous slurry, and complete burning of the residue can be carried out within a shorter period of time.

Since by adjusting the amount of the oil in the slurry to at least 0.5 part by weight, preferably at least 1 part by weight, per part by weight of the solid residue, the solid residue can be burned up almost within the flame of the burner, the unburned ash residue hardly adheres to the heating pipe.

Furthermore, the unburned residue is maintained at 800° to 1000° C. and can be completely burned in the secondary combustion chamber in which the residence time of the combustion gas is adjusted to at least 0.5 second. The ash and other residues can be discharged from the ash reservoir chamber and the discharge port provided at the bottom of the secondary combustion chamber without shut-down.

As stated above, the heating medium heating furnace and the incinerator for solid residues, which are separately provided in the prior art, can be combined into one integral unit in accordance with this invention. The operating procedure becomes easier, and simultaneously, the investment cost and the operating cost can be curtailed.

EXAMPLE

To an apparatus comprised of a first combustion chamber having a volume of 195 m$^3$, a secondary combustion chamber having a volume of 25 m$^3$ and a tertiary combustion chamber having a volume of 19.4 m$^3$ was fed through a pipe 14 (in FIG. 2) a slurry (1700 kg/hr) composed of 20.6% by weight of terephthalic acid and other organic material, 8.8% by weight of water and 70.6% by weight of C heavy oil at a speed of 0.41 m/sec at a temperature of 100° C. and a pressure of 5 kg/cm$^2$G. At the same time, 18379 Nm$^3$/hr of combustion air and 600 kg/hr of atomizing steam for the burner were fed. In the secondary combustion chamber, burning was carried out stably at a temperature of 900° C. and a pressure of −2 mmAg with a residence time of 1.0 second. The tertiary combustion chamber was operated with a residence time of 0.83 second. As a result of the above stable burning, $13.6\times10^6$ kcal/hr of heat could be exchanged by using about 610 tons/hr of a heating medium.

We claim:

1. A method of burning a combustible solid residue from a chemical plant, which comprises feeding a slurry of combustible solid residues in an oil, the amount of the oil being at least 0.5 part by weight per part by weight of the combustible solid residues, into a burner in a combustion furnace comprised of a main combustion chamber having the burner in its arch, a secondary combustion chamber formed in the lower portion of the main combustion chamber, and a flue gas duct provided beneath and following the secondary combustion chamber, burning the residue in the main combustion chamber, conducting the combustion gas into the secondary combustion chamber, and allowing it to reside at a temperature 800° to 1000° C. for at least 0.5 second.

2. The method of claim 1 in which the main combustion chamber has a heating pipe disposed vertically along its side wall, and a heating medium in the heating pipe is heated.

3. The method of claim 1 in which the combustion gas in the secondary combustion chamber is maintained at 850° to 950° C.

4. The method of claim 1 in which the residence time of the combustion gas in the secondary combustion chamber is adjusted to 0.5 to 1.0 second.

5. The method of claim 1 in which the chemical plant is a terephthalic acid manufacturing plant.

6. The method of claim 1 in which the slurry contains at least 1 part by weight of the oil per part by weight of the combustible solid residue.

7. The method of claim 1 in which the combustion furnace further has a tertiary combustion chamber following the flue gas duct and a second flue gas duct connected to the tertiary combustion chamber, and the combustion gas is conducted from the secondary combustion chamber to the tertiary combustion chamber and is allowed to reside therein for at least 0.5 second.

8. A combustion furnace for burning combustible solid residues from a chemical plate, comprising a main combustion chamber having a burner in an arch in the main combustion chamber and a heating pipe disposed vertically along a side wall, a secondary combustion chamber provided in a lower part of the main combustion chamber, a flue gas duct provided beneath the secondary combustion chamber, and a burning residue reservoir chamber provided at the bottom of the furnace.

9. The combustion furnace of claim 8 which further comprises a tertiary combustion chamber following the flue gas duct and a second flue gas duct connected thereto.

10. The combustion furnace of claim 9 in which the tertiary combustion chamber is provided vertically, and the second flue gas duct is connected to the breaching of the tertiary combustion chamber.

11. A combustion furnace for burning combustible solid residues from a chemical plant, comprising a main combustion chamber having an arch, a burner in the arch, a secondary combustion chamber provided in a lower part of the main combustion chamber, flue gas duct provided beneath the secondary combustion chamber, a burning residue reservoir chamber provided at the bottom of the furnace, a tertiary combustion chamber following the flue gas duct, a second flue gas duct connected to the tertiary combustion chamber, and a heating pipe in the tertiary combustion chamber.

12. The combustion furnace of claim 11 in which the tertiary combustion chamber is provided vertically, and the second flue gas duct is connected to the breaching of the tertiary combustion chamber.

13. The combustion furnace of claim 11 in which a heating pipe is disposed vertically in the main combustion chamber along the side wall.

14. The combustion furnace of claim 11 in which the heating pipe of the main combustion chamber and the heating pipe in the tertiary combustion chamber are connected by means of a crossover pipe.

15. A combustion furnace for burning combustible solid residues from a chemical plant, comprising a main combustion chamber having an arch, a burner in the arch, a secondary combustion chamber provided in a lower part of the main combustion chamber, a flue gas duct provided beneath the secondary combustion chamber, a burning residue reservoir chamber provided at the bottom of the furnace, a tertiary combustion chamber following the flue gas duct, a second flue gas duct connected to the tertiary combustion chamber, and a waste heat boiler in the tertiary combustion chamber.

16. The combustion furnace of claim 15 in which a heating pipe is disposed vertically in the main combustion chamber along the side wall.

17. The combustion furnace of claim 16 in which the tertiary combustion chamber is provided vertically, and the second flue gas duct is connected to the breaching of the tertiary combustion chamber.

* * * * *